United States Patent [19]

Rohr et al.

[11] 3,957,548

[45] May 18, 1976

[54] PROPELLING CHARGE COMPOSITION FOR EFFICIENCY INCREASED AMMUNITION

[75] Inventors: Horst Rohr, Trechtingshausen; Karl-Otto Wehlow, Hargesheim, both of Germany

[73] Assignee: Firma Josef Schaberger & Co. GmbH, Germany

[22] Filed: Mar. 19, 1974

[21] Appl. No.: 452,581

[30] Foreign Application Priority Data

Mar. 20, 1973 Germany ..... 2313856

[52] U.S. Cl. ..... 149/10; 149/11; 149/21; 149/98; 149/2

[51] Int. Cl.[2] ..... C06B 45/28

[58] Field of Search ..... 149/21, 3, 2, 10, 11, 149/98

[56] References Cited

UNITED STATES PATENTS 2,335,804 11/1943 Silk ..... 149/10

*Primary Examiner*—Stephen J. Lechert, Jr.
*Attorney, Agent, or Firm*—Pollock, Vande Sande & Priddy

[57] ABSTRACT

Propelling charge composition of a mixture of two powder components of different burning rates wherein the quicker burning powder component has a protective coating which retards its combustion.

5 Claims, 3 Drawing Figures

PROPELLING CHARGE COMPOSITION FOR EFFICIENCY INCREASED AMMUNITION

The combustion speed of propelling charge powders in gun weapons depends on the pressure within the combustion chamber. This pressure is influenced by the volume of the combustion chamber which extends following the movement of the projectile.

Pressure increase and pressure developement within the combustion chamber are above all determined by the powder surface, that means, by the way the surface of the powder developes during the combustion.

Since the gas pressure within the powder chamber and especially the developement of the pressure at the base of the projectile determine the speed of the projectile which leaves the gun, investigations have been made to increase the speed of the projectile without changing the max. pressure within the combustion chamber (with regards to the weight of the weapon the pressure must not be increased at choice).

This effect can be obtained under condition that the developement of pressure within the combustion chamber is regulated to avoid pressure peaks. That means, that it is very imortant to keep the combustion chamber pressure at the same level during the trajectory of the projectile. That could be reached with vonventional powders if the combustion surfaces extended extremely during the combustion or if the combustion speed of the powder grain increased very much. Since these stipulations are not sufficiently fulfilled the gas pressure of gun weapons shows always approx. the same characteristic developement (see FIG. 1), that means, the pressure rises relatively steep and decreases quickly at the moment the projectile passes across the gun.

Following the invention, an almost perfect pressure developement can be regulated in that way:

The propelling charge consists of two different powder types as to combustion time and combustion characteristics. Each grain of the quicker burning powder is coated to obtain a delay of combustion. Thus, combustion starts at the moment in which the pressure peak — caused by the combustion of the slower burning powder — begins to decrease because of the cooling and the movement of the projectile.

By the fact of a shorter burning time of the coated powder it is ensured that the whole propellant charge is burnt when the projectile is leaving the gun. In this case, it is not important if the short burning time is caused by a high combustion speed or by a large powder surface which depends of the grain size.

Figure 2:
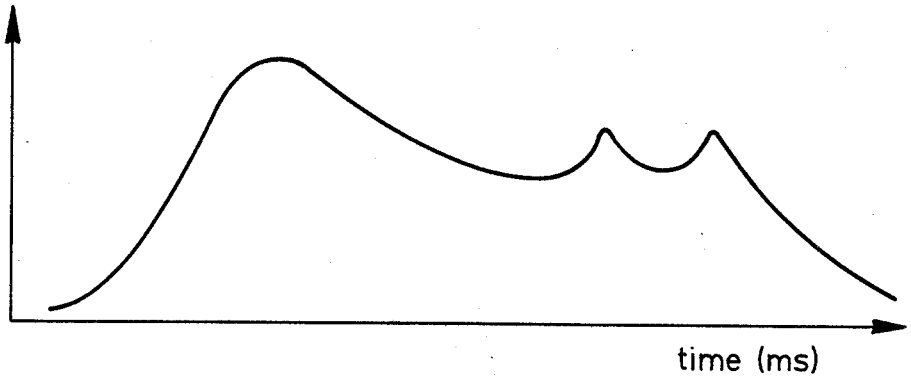

FIG. 2 represents a characteristic pressure developement as it can be obtained with a propellant charge arrangement conformable to the invention.

Figure 1:
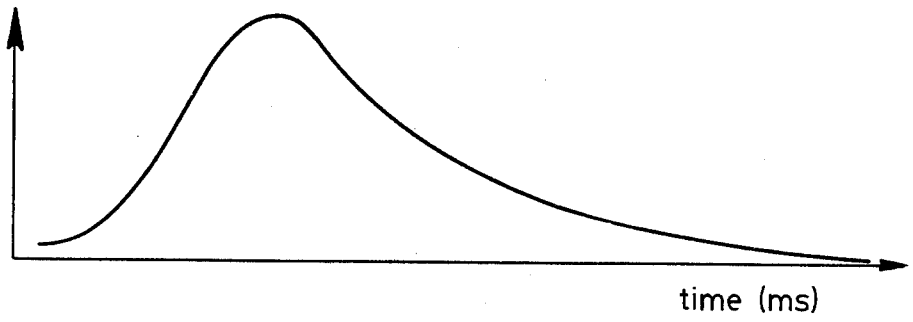

In comparision to FIG. 1 you see the effect of the longer influence of gas pressure on the projectile without a considerable increase of the max. gas pressure.

Here it is important that the combustion of the quicker burning powder is retarded by the special coating.

Conformable to the invention, the combustion delay is obtained by means of a film consisting of gelatine or gelatine- gum arabic. This film envelopes each powder grain completely, but not in an adhesive way. That ensures, that in case this coating is damaged only the ignition moment is concerned but not the combustion characteristics of the powder.

If this coating sticked tightly on the grain the powder surface would start to burn at the unprotected spot in case the coating had been damaged. Thus, the combustion would not take the defined course.

Figure 3:
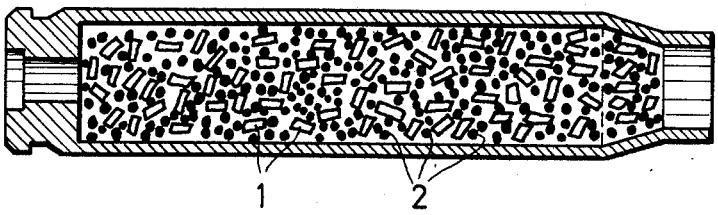

The following example of a characteristic charge composition may explain the invention:

The cartridge for a 30 mm gun is filled with the following powder types (see FIG. 3):

Type 1 is a powder of the longer burning time, e.g. 35 g of a 19-hole powder (diameter of cylinder 4mm, length of cylinder 6 mm).

Type 2,a powder of the shorter burning time with a coating of gelatine- gum arabic, e.g. 15 g of a ball powder (nitrocellulose-nitroglycerine-powder, about 10% nitroglycerine), medium diameter 0,3 mm, coated by a protecting film which makes about 5 % of the weight of the powder.

The materials employed for the coating of the powder grain with regard to a combustion delay are gelatine or gelatine-gum arabic. An appropriate coating procedure is object of the patent DBP 1,122,495.

The following example is presented to illustrate the preparation conformable to the invention:

1000 g ball powder are put into 3 l water and kept in suspension by stirring. Then a sol of 60 g pigskin gelatine (IEP = PH 8) and 540 g water are added. Another sol of 60 g gum arabic and 540 g water are added. The PH of this mixture of solid matter and colloid is of about 5,4. These preparations are done at a temperature of 50°C. The complex coacervation takes place at PH 4,5 and is started by adding acetic acid of 10 %. The complex colloid deposes then round the powder particels.

After this, the capsules are hardened by stirring and adding of 10 g formaldehyde solution of 40 %. The temperature is still 50°C.

Then the mixture is stirred during further 30 min. The temperature is now reduced at 10°C while the complex colloid gelates.

To complete the hardening process the pH-value of the mixture is regulated at 8 by adding a solution of bicarbonate of soda of 20%.

This hardening process completed, the coated ball powder grains are filtered and separated from each other while they are drying.

This coated and dry grains can be graphitized by means of known methods in order to avoid electrostatic charge and to improve the flowability.

We claim:

1. Propelling charge composition consisting of a mixture of two powder components, respectively powder types (1) and (2) of different burning time whereby the quicker burning powder component, respectively powder type (2) is retarded in its initial combustion by means of a protective coating of gelatine or gelatine-gum arabic wherein said coating does not stick tightly on the enveloped powder grain; wherein the slowly burning component (1) has a nitroglycerine content of about 10% and is a ball powder and the quicker burning component respective powder type (2) is a nitrocellulose-nitroglycerine powder of about 10% nitroglycerine.

2. The composition of claim 1 wherein the slowly burning component (1) with a content of nitroglycerine of about 10% is a 19-hole powder of cylindric particles with a diameter of 4 mm and a length of 6 mm.

3. The composition of claim 2 wherein the nitrocellulose-nitroglycerine powder with about 10% nitroglycerine is a ball powder with a medium ball diameter of 0.3 mm whereby the protective film coating the ball powder consists of about 5% of the weight of the powder.

4. The composition of claim 3 wherein the weight percent of the 19-hole powders is about 70 and the weight percent of the nitrocellulose-nitroglycerine powder with about 10% nitroglycerine is about 30.

5. The composition of claim 2 wherein the weight percent of the 19-hole powders is about 70 and the weight percent of the nitrocellulose-nitroglycerine powder with about 10% nitroglycerine is about 30.

* * * * *